US010470505B2

(12) United States Patent
Chua et al.

(10) Patent No.: US 10,470,505 B2
(45) Date of Patent: Nov. 12, 2019

(54) PROTECTIVE APPAREL SYSTEM WITH IMPERVIOUS PROTECTION

(71) Applicant: Medline Industries, Inc., Mundelein, IL (US)

(72) Inventors: Mark Spencer Chua, Northbrook, IL (US); Michael Seefeldt, Libertyville, IL (US); Francis Czajka, Libertyville, IL (US)

(73) Assignee: Medline Industries, Inc., Mundelein, IL (US)

( * ) Notice: Subject to any disclaimer, the term of this patent is extended or adjusted under 35 U.S.C. 154(b) by 448 days.

(21) Appl. No.: 14/271,493

(22) Filed: May 7, 2014

(65) Prior Publication Data

US 2015/0320124 A1 Nov. 12, 2015

(51) Int. Cl.
*A41D 13/12* (2006.01)
*A42B 3/28* (2006.01)

(52) U.S. Cl.
CPC ..... *A41D 13/1218* (2013.01); *A42B 3/286* (2013.01); *A41D 2400/52* (2013.01)

(58) Field of Classification Search
CPC ..... A41D 13/0002; A41D 13/1153; A41D 13/1218; A41D 2400/52; A42B 3/286
USPC ..... 2/457
See application file for complete search history.

(56) References Cited

U.S. PATENT DOCUMENTS 932,880 A * 8/1909 Meikle ..... A62B 17/006 128/201.29
1,004,850 A 10/1911 Cogil
1,095,089 A * 4/1914 Dinn ..... A62B 17/006 128/201.29
1,255,249 A 2/1918 Wade et al.
1,313,908 A 8/1919 Polasky
2,171,337 A 10/1938 Hellmann et al.
2,456,130 A 12/1948 Lambertsen
2,460,269 A 2/1949 Appeldorrn
2,573,414 A * 10/1951 Dunn ..... A41D 13/0025 128/201.29

(Continued)

FOREIGN PATENT DOCUMENTS

DE 2442881 A1 3/1976
EP 0236620 A1 9/1987

(Continued)

OTHER PUBLICATIONS

Notification of Transmittal of the International Search Report and the Written opinion of the International Search Authority, or the Declaration; International Patent Application No. PCT/US2015/027225, Medline Industries, Inc. (Chua, Mark Spencer, et al); Jul. 14, 2015.

(Continued)

*Primary Examiner* — Anne M Kozak
(74) *Attorney, Agent, or Firm* — Robert D. Spendlove; Gurr Brande & Spendlove, PLLC

(57) ABSTRACT

A protective apparel system is provided that comprises a helmet covering the wearer's head and a gown covering the wearer's body. A protective barrier extends between the helmet and the gown in order to separate an interior space from the exterior space. The helmet may be a reusable rigid helmet with an exterior surface that can be repeatedly disinfected. The helmet may also include an air transmission system.

22 Claims, 6 Drawing Sheets

(56) References Cited

U.S. PATENT DOCUMENTS 2,773,262 A 12/1956 Brouha et al.
2,904,040 A 9/1959 Hale
3,302,214 A 2/1967 Yuritch
3,351,056 A * 11/1967 Durney ..... A62B 17/00 128/202.11
3,529,594 A * 9/1970 Charnley ..... A41D 13/0025 128/201.23
3,688,314 A * 9/1972 Hill ..... A62B 18/04 128/201.24
3,707,004 A * 12/1972 Kapitan ..... A42B 3/0473 128/201.23
4,042,976 A * 8/1977 Reynolds ..... A41D 23/00 2/135
4,272,851 A * 6/1981 Goldstein ..... A41D 27/24 2/275
4,286,170 A * 8/1981 Moti ..... G21F 3/02 2/9
4,386,277 A * 5/1983 Forshee ..... G21F 3/02 2/9
4,513,452 A 4/1985 Rankin, Sr. et al.
4,639,254 A 1/1987 Legault et al.
4,672,968 A 6/1987 Lenox et al.
4,673,402 A 6/1987 Weisman et al.
4,699,620 A 10/1987 Bernardin
4,838,885 A 6/1989 Bernardin
4,845,779 A * 7/1989 Wheeler ..... A41D 13/1153 2/69
4,859,184 A 8/1989 Hazard
4,878,046 A 10/1989 Smith
4,901,716 A * 2/1990 Stackhouse ..... A41D 13/1153 128/201.25
5,046,492 A 9/1991 Stackhouse et al.
5,047,023 A 9/1991 Berg
5,054,480 A 10/1991 Bare et al.
5,134,007 A 7/1992 Reising et al.
5,176,668 A 1/1993 Bernardin
5,188,624 A 2/1993 Young, Sr. et al.
5,253,642 A * 10/1993 Stackhouse ..... A41D 13/11 128/201.25
5,294,478 A 3/1994 Wanek et al.
5,295,271 A * 3/1994 Butterfield ..... A42B 3/0473 2/410
5,348,547 A * 9/1994 Payne ..... A61F 13/49009 604/378
5,466,513 A * 11/1995 Wanek ..... A61F 13/53747 428/218
5,492,110 A 1/1996 Lenz et al.
5,592,936 A * 1/1997 Thomas, Jr. ..... A41D 13/11 128/201.24
5,646,785 A 7/1997 Gilboa et al.
5,649,532 A 7/1997 Griffiths
5,655,374 A * 8/1997 Santilli ..... A41D 13/1218 2/905
5,711,033 A 1/1998 Green et al.
6,062,976 A * 5/2000 De Guzman ..... A41D 13/0005 15/301
6,370,695 B2 * 4/2002 Paris ..... 2/171.3
6,374,823 B1 * 4/2002 Hajianpour ..... A62B 17/04 128/201.22
6,393,617 B1 * 5/2002 Paris ..... A41D 13/11 2/171.3
6,481,019 B2 11/2002 Diaz et al.
6,513,168 B2 2/2003 Paris et al.
6,513,186 B1 2/2003 Zimmer
6,622,311 B2 9/2003 Diaz et al.
6,711,748 B2 3/2004 Paris et al.
6,751,807 B2 * 6/2004 Klotz ..... A41D 13/0025 2/171.3
6,874,170 B1 * 4/2005 Aaron ..... A41D 13/0512 2/421
6,973,677 B2 12/2005 Diaz et al.
6,990,691 B2 * 1/2006 Klotz ..... A41D 13/1153 2/171.3
7,120,941 B2 10/2006 Glaser
7,200,873 B2 4/2007 Klotz et al.
7,602,052 B2 10/2009 Baker
7,735,156 B2 6/2010 Van Der Woude et al.
7,748,060 B2 * 7/2010 Plut ..... A41D 13/02 2/457
7,752,682 B2 7/2010 Van Der Woude et al.
7,937,775 B2 5/2011 Manzella, Jr. et al.
7,937,779 B2 5/2011 Klotz et al.
8,020,552 B2 9/2011 Dillon et al.
8,234,722 B2 8/2012 Van Der Woude et al.
8,282,234 B2 10/2012 Van Der Woude et al.
8,291,521 B2 10/2012 Mazzarolo et al.
8,393,017 B2 3/2013 Sheren
2002/0134381 A1 9/2002 Bonhomme et al.
2005/0109337 A1 5/2005 Diaz et al.
2006/0213523 A1 9/2006 Van Der Woude et al.
2007/0028372 A1 * 2/2007 Vanderwoude .... A41D 13/1153 2/457
2007/0050898 A1 3/2007 Larson et al.
2007/0089221 A1 * 4/2007 Manzella, Jr. ..... A41D 13/0025 2/456
2007/0138415 A1 * 6/2007 Rees ..... G21F 3/02 250/516.1
2007/0151002 A1 7/2007 Klotz et al.
2008/0202509 A1 * 8/2008 Dillon ..... A41D 13/1153 128/201.25
2009/0151054 A1 * 6/2009 VanDerWoude ... A41D 13/1153 2/410
2010/0229290 A1 9/2010 Nelson
2011/0004979 A1 1/2011 Van Der Woude et al.
2011/0145978 A1 6/2011 Harbin
2011/0226240 A1 * 9/2011 Navalesi ..... A61M 16/06 128/201.23
2011/0289954 A1 * 12/2011 Zhang ..... A62B 18/003 62/259.3
2012/0240316 A1 * 9/2012 Czajka ..... A41D 13/1218 2/456
2013/0036538 A1 2/2013 Sheren
2013/0042861 A1 * 2/2013 Baek ..... A42B 3/0406 128/201.25
2013/0091624 A1 * 4/2013 Czajka ..... A41D 13/1218 2/456
2013/0205480 A1 * 8/2013 Nagely ..... A63B 71/1291 2/425

FOREIGN PATENT DOCUMENTS

GB 1007197 A 10/1963
GB 1395099 5/1975
WO 2012129396 A1 9/2012

OTHER PUBLICATIONS

International Search Report and Written Opinion dated Jun. 22, 2012 for PCT Application No. PCT/US2012/030107.
Partial European Search Report completed Mar. 17, 2014 for European Patent Application No. EP139634.

* cited by examiner

PROTECTIVE APPAREL SYSTEM WITH IMPERVIOUS PROTECTION

FIELD OF THE DISCLOSURE

The present disclosure relates generally to protective garments, and more particularly to protective apparel for use in medical environments, such as surgical environments, to protect both patients and medical personnel from contamination during surgical procedures.

BACKGROUND OF THE DISCLOSURE

Protective apparel may be worn by surgeons and other caregivers or other medical personnel in order to protect patients from infection. Orthopedic procedures and particularly those involving exposed bone are very susceptible to infection and osteomyelitis. Therefore protective apparel may be used to create a sterile field, typically achieved by a gown, often referred to as a "toga" that provides a barrier between the healthcare professionals and the patient.

In some cases, helmets may be worn on the head of the surgical staff supporting the protective apparel. Such helmets are exposed, open-air helmet that may include a built-in fan and that cooperate with a whole-body disposable "toga" that works specifically with the helmet. The purpose of this is to provide a complete impervious sterile layer around the surgeon/staff for bloody orthopedic cases while having a fan element inside in order to facilitate cooling. Because of the necessity to maintain sterility, the entire outer toga is sterile and disposable so that it can be worn as a complete sterile barrier.

In current protective garments, the reusable cooling system, which may be in the form of a wrap-around head frame, is enclosed within a disposable barrier. As a result, the outer disposable barrier must be completely sterile and must be carefully draped over the head frame. It is difficult to don the protective toga aseptically, because the toga must somehow drape over the exposed helmet and over the body without touching or being contaminated by a non-sterile surface. As a result, it usually takes at an extra person to assist the surgeon with donning the helmet and the toga before surgery. Additionally, because the disposable part is typically a fabric or non-woven that is draped over the exposed helmet, there is an element of drag and instability when moving around with the toga.

Fans have been incorporated into the helmet and positioned on top of the user's head, and may add even more weight to the helmet further exacerbating the weight and center of gravity issues described above. The fan may draw air in through the gown material and may result in increased current drain on the fan. This may result in reduced battery life or an increased size of the power source to effectively transport air into the interior space of the protective suit.

Thus, there is a need for a protective apparel system including a reusable cooling system in which all of the cooling elements are enclosed inside a protective helmet-like device, a disposable barrier and a toga. The disposable barrier is mated to a lower portion of the helmet thereby permitting surgical staff to don a toga and helmet while maintaining toga sterility.

The various aspects, features and advantages of the disclosure will become more fully apparent to those having ordinary skill in the art upon careful consideration of the following Detailed Description thereof with the accompanying drawings described below.

DETAILED DESCRIPTION

Figure 2:
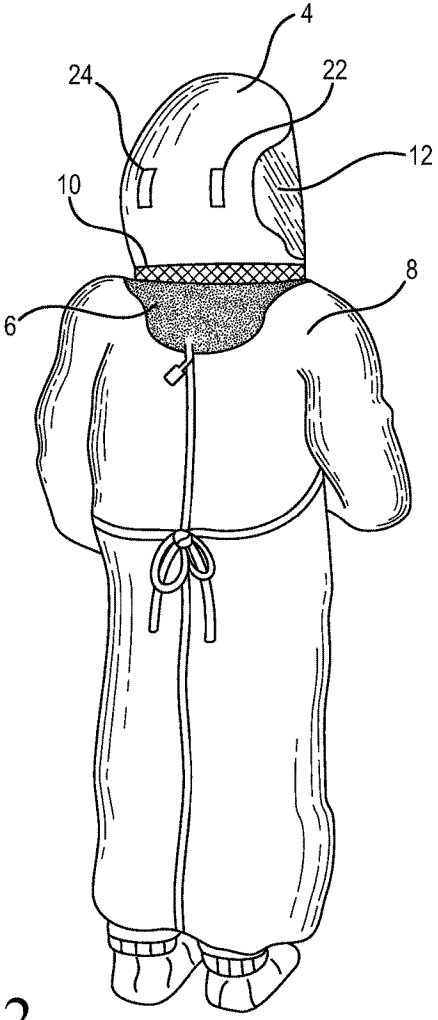
FIG. 2 is a rear perspective view of the embodiment of FIG. 1.

Before describing in detail embodiments that are in accordance with the present invention, it should be observed that the embodiments reside primarily in combinations of apparatus components and method steps for a protective apparel and support system. Accordingly, the apparatus components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In describing the embodiments herein in detail and referring to the drawings, like numbers indicate like parts throughout the figures. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. As used herein, the terms "connected," "attached" and the like include a relationship in which two elements are physically fastened together by a securing means but may also include a relationship in which two elements are in contact with each other without physical fastening. For example, two sections of protective apparel that overlap in order to define an interior space separate from an exterior space may be "connected" even though they are not fastened or secured to each other.

While some embodiments described herein reference a user or wearer, specifically a surgeon, embodiments of a protective apparel and support apparatus can be used by any user and/or wearer, for example, surgeons and/or other doctors, scientists, students, or any other user that can use protective apparel. In this manner, while some embodiments described herein can reference a patient, in other embodiments, the wearer may be working on, for example, an experiment, a hazardous material, or any other object and/or situation that may prefer protective apparel.

According to the present invention, there is provided a system in which a durable, reusable helmet with integrated cooling system includes a protective barrier that is exposed to the environment. Owing to the configuration of the combined helmet and protective barrier, the user is provided with an improved system for maintaining the sterility of the associated protective gown. An advantage of the present invention is that the user does not experience the same level of difficulty in putting a sterile gown over the head/helmet.

Figure 1:
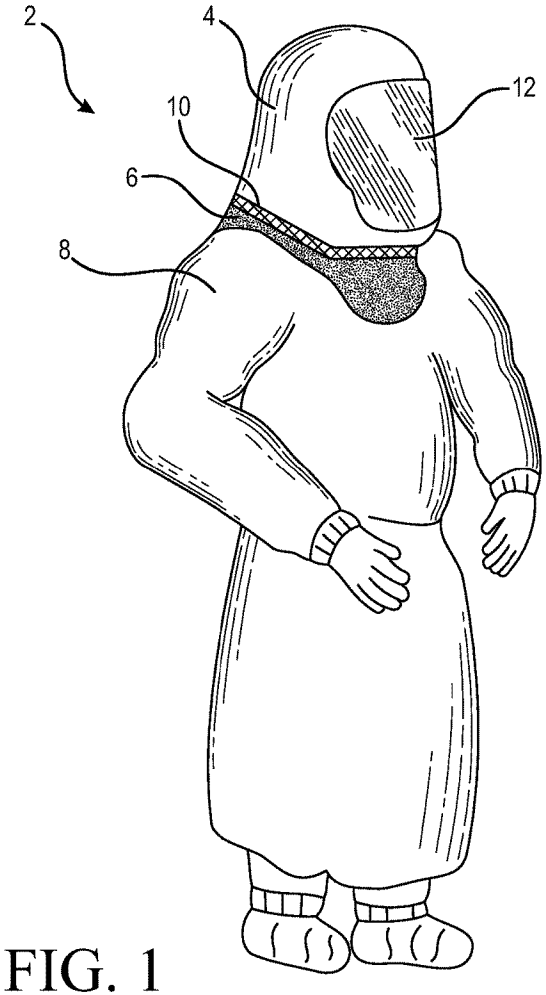
FIG. 1 is a front perspective view of an embodiment of a protective garment in accordance with the invention.

FIGS. 1 and 2 depict a protective apparel system 2 according to an embodiment of the invention. The system 2 includes a reusable helmet 4, a disposable protective barrier 6, and a disposable gown 8. The helmet 4 is made from a durable material that is capable of being disinfected or sterilized. In some embodiments, the helmet material may be rigid. The helmet 4 may be disinfected through sterilization or disinfecting wipes or some other method or combination of methods of disinfection known in the art. The helmet 4 includes a transparent portion 12 that allows the wearer to see. This transparent portion may extend over a greater or letter portion of the helmet 4, including over a majority of the helmet. Along a lower portion 10 of the helmet 4 there is provided an opening for receiving a human head.

A disposable protective barrier 6 may be connected to the lower portion 10 of the helmet 4. One or more securement devices may be placed at various positions along the lower portion 10 of the helmet 4 to connect the disposable protective barrier 6 to the helmet 4. Once connected, disposable protective barrier 6 may extend over a disposable gown 8. Alternatively, the protective barrier 6 may extend under a collar of the disposable gown 8 or may be attached to or integrally formed with the gown.

Figure 3:
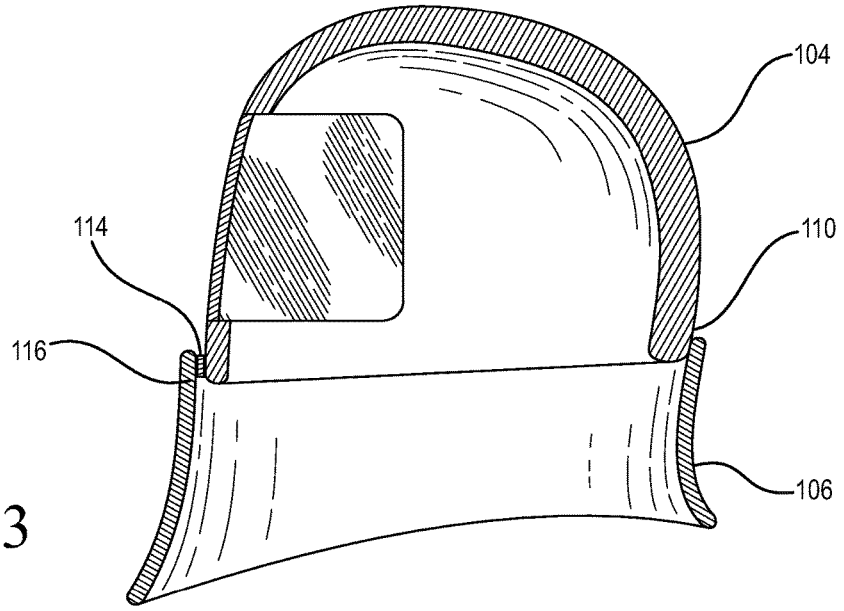
FIGS. 3-6 are cross-sectional views of various embodiments of a helmet and protective barrier of the protective garment.

The protective barrier 6 may attach to the helmet 4 in various ways. For example, as shown in FIG. 3, a protective barrier 106 may have an upper portion 116 that extends at least partially around an outer lower portion 110 of the helmet 104. The barrier 106 may be connected to the helmet 104 by a fastening mechanism 114. The fastening mechanism 114 may comprise various different mechanisms capable of attaching the barrier to the helmet. In different embodiments the fastening mechanism may include continuous or intermittent sections of adhesive, hook-and-loop fasteners or other interlocking fastener material or may include buttons, snaps, staples or other securement devices, or a combination thereof.

Figure 4:
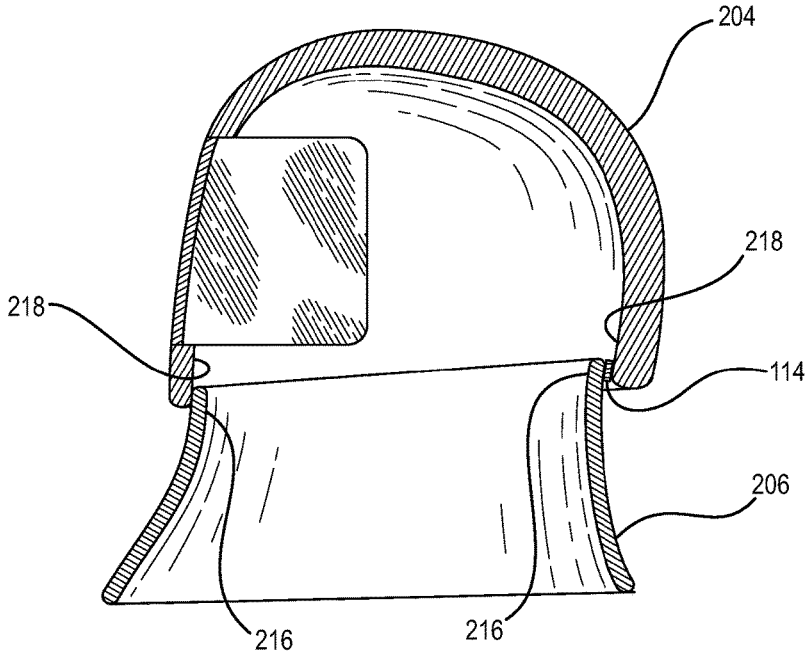

Alternatively, as shown in FIG. 4, a protective barrier 206 may have an upper portion 216 that extends at least partially around an inner lower portion 218 of the helmet 204. As discussed with respect to FIG. 3, the barrier 206 may be connected to the helmet 204 by a fastening mechanism 114.

Figure 5:
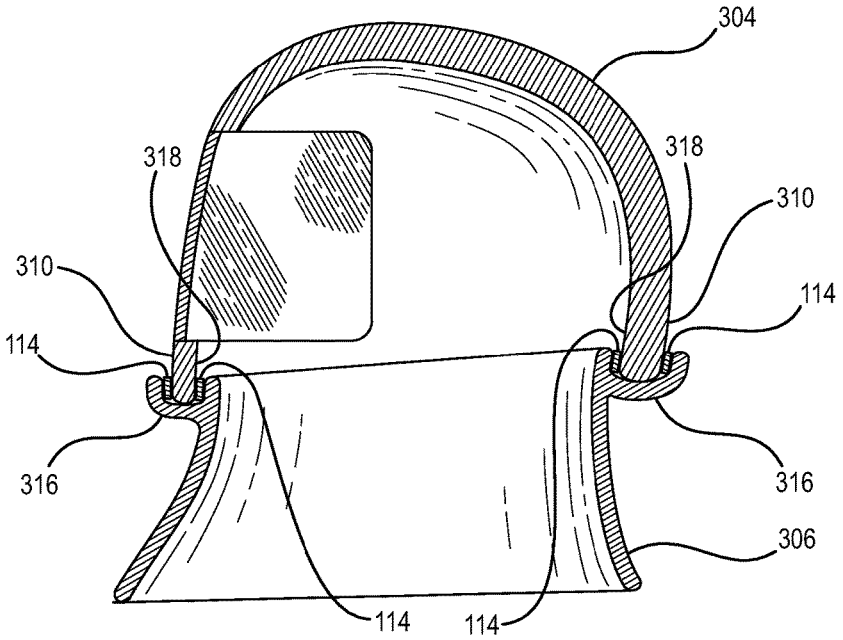

In a further embodiment, as shown in FIG. 5, a barrier 306 may have an upper portion 316 that wraps around the lower edge of the helmet 304 and attaches to both and inner lower portion 318 and an outer lower portion 310. The fastening mechanisms 114 may be applied on both the inner 318 and outer 310 portions. Alternatively, the upper portion 316 of the barrier 306 may be attached only on one of the inner and outer portion and the helmet 306 and may be held around the helmet lower edge by means of elastics or a rigid section of upper portion 316.

Figure 6:
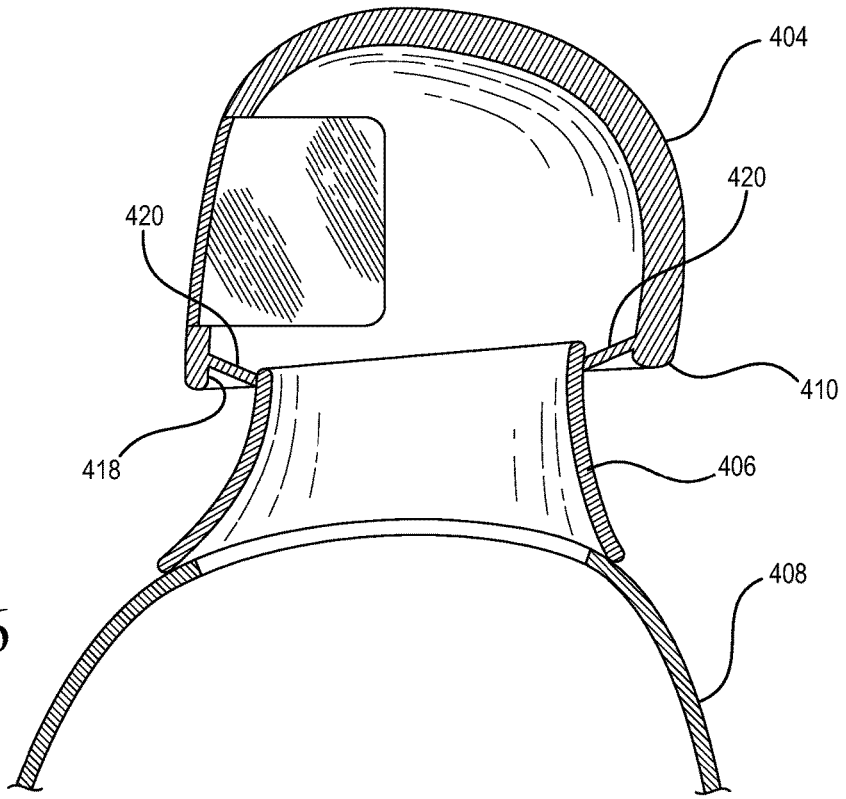

In an additional embodiment, illustrated in FIG. 6, a protective barrier 406 may be connected to and extend upwardly from a collar area of a disposable gown 408. The protective barrier 406 extends into an area covered by the helmet 404 once the helmet is placed upon the wearer's head and shoulders. In some embodiments, this protective barrier 406 may in a form reminiscent of a turtleneck style collar. The protective barrier 406 may or may not attach directly to the helmet lower portion 410 in a manner similar to those illustrated in FIGS. 3-5. In a further embodiment, shown in FIG. 6, a flange 420 may extend inwardly from an inner lower portion 418 of the helmet 404. This flange 420 may contact or be attached to the protective barrier 406.

The protective barrier 406 may be configured such that it lies generally flat against the gown 408 when not in use or when the wearer initially dons the gown. The protective barrier may then be extended to interact with the helmet.

Figure 7:
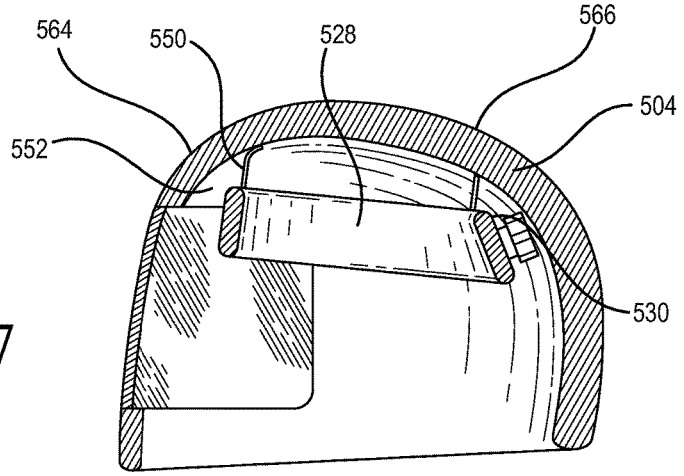
FIG. 7 is a cross-sectional view of an embodiment of a helmet and support structure of the protective garment.
Figure 8:
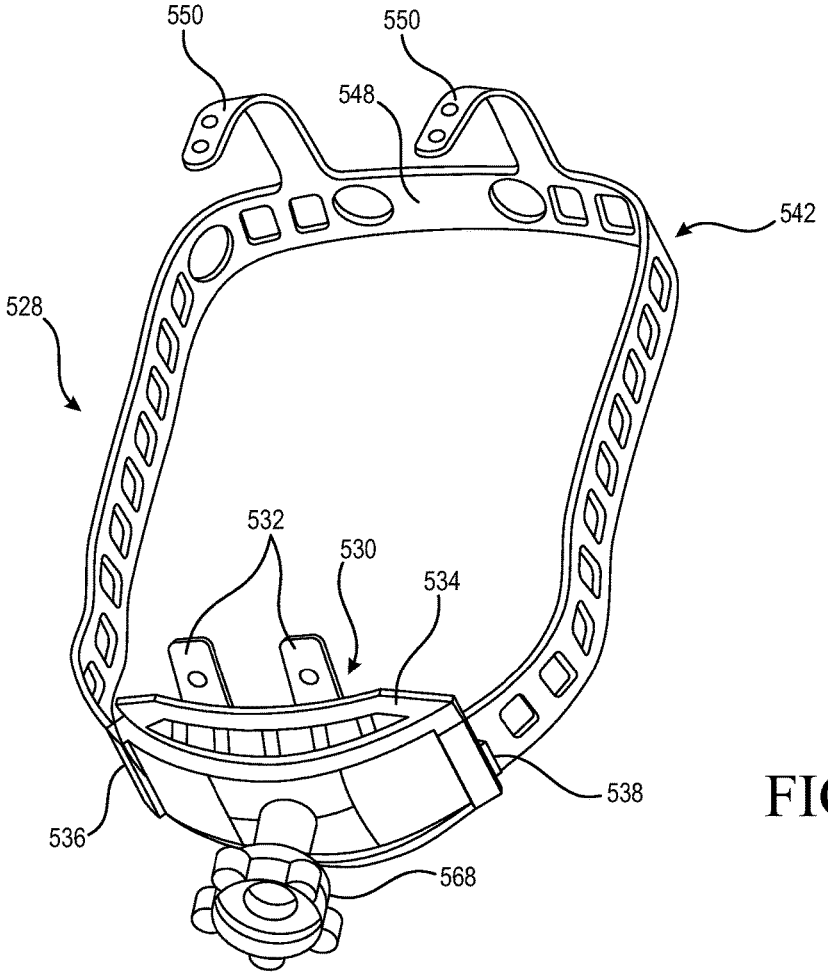
FIG. 8 is a perspective view of a head band of the embodiment illustrated in FIG. 7.

As illustrated in FIGS. 7 and 8, the helmet 504 may be supported on the wearer's head by an adjustable head band 528 that is suspended within the helmet. The head band 528 includes a rear support 530 that rigidly extends from the helmet 504. It is understood that the rear support 530 can be a separate part that is connected to the helmet 504 or can be an integral part of the helmet. The rear support 530 may include first and second rigid connectors 532 that connect the rear support 530 to a rear section 566 of the helmet 504. However, it is to be understood that the rear support 530 can connect to and extend from any portion of the helmet.

An adjustment segment 534 having a first side 536 and a second side 538 may also be part of head band 528. The adjustment segment 534 may be integral to, or the same part as, the rear support 530. In alternative embodiments, the adjustment segment 534 is a discrete component that is simply mounted to the rear support 530. In either situation, the adjustment segment 534 defines apertures for receiving first and second ends of a strap 542 flexibly connected to and extending from the front section 564 of the helmet 504. Movement of the ends of the strap within the adjustment segment 534 allows for adjustment of the strap 542 to more comfortably fit the heads of various wearers. The adjustment segment 534 may include a knob 568 attached to a mechanism that engages the ends of strap 542. Turning the knob 568 incrementally adjusts that apparent size of strap 542.

The strap 542 further includes a frontal portion 548 disposed between its first and second ends and opposite the adjustment segment 534 of the rear support 530. At least one support arm 550 flexibly extends from the frontal portion 548 of the strap 542 to flexibly connect the strap 542 to the front section 564 of the helmet 504. These support arms 550 act as hinges for the support assembly. There may be two support arms 550 that extend from the frontal portion 548 of the strap 542. In such a case, the two supports arms are connected to the front section 564 of the helmet and to the frontal portion 548 of the strap 542 equidistant from one another. A gap 552 exists between the frontal portion 548 of the strap 542 and the front section 564 of the helmet 504.

Figure 9:
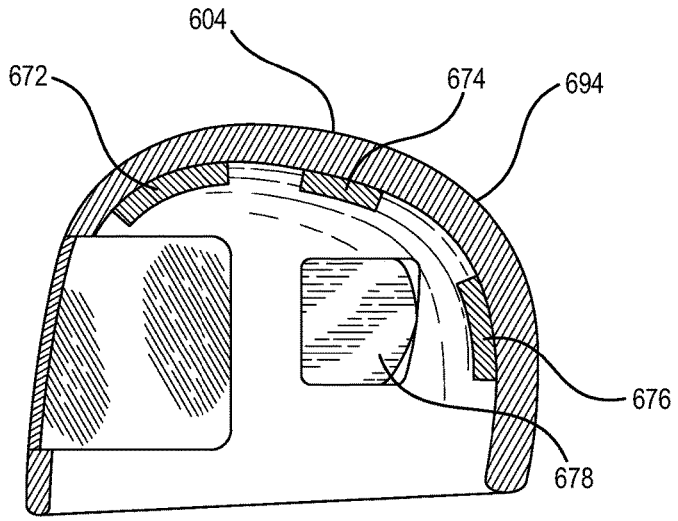
FIG. 9 is a cross-sectional view of a further embodiment of a helmet and support structure.

In an alternative embodiment, as illustrated in FIG. 9, a series of spacers or pads may be positioned at various locations within the helmet 604 in order to secure the helmet on the wearer's head and space the helmet shell 694 from the wearer's head. For example, a front 672, center 674 and rear 676 pads may be positioned along a central axis of the helmet 604 to space the helmet shell 694 from the wearer's head. Side pads 678 may also be employed to stabilize the helmet. The pads may comprise foam, gel or other appropriate padding and may be adhered to an inner surface of the helmet shell 694 or may be attached with hook-and-loop, snaps or other fastening elements. The helmet may be provided with a series of pad of varying thickness for one or more of the pad positions in order to adjust the fit of the helmet to the wearer's head.

Figure 10:
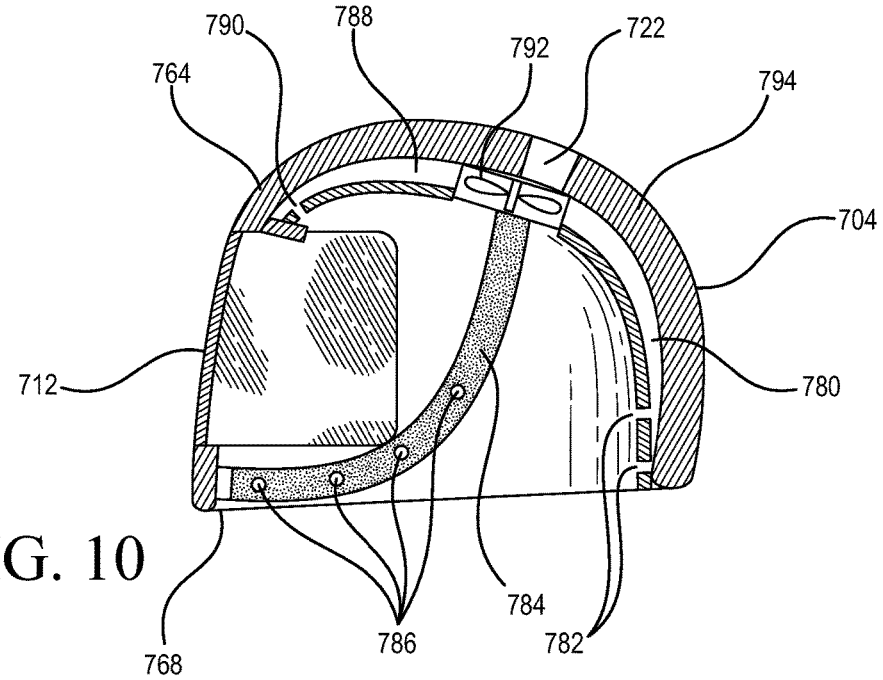
FIG. 10 is a cross-sectional view of an embodiment of an air transmission system for the protective garment.

Returning to FIG. 1, the helmet 4 may include a first air port 22, which is a void or opening in the helmet 4. The air port 22 is configured to substantially align with and be coupled to an air transmission system, as illustrated in FIG. 10. The helmet further includes a second air port 24, which is a void or opening in the helmet. The air port 24 is also configured to be coupled to the air transmission system. Theses air ports 22, 24 allow for the flow of air between the interior barrier space and an exterior space. In some embodiments, one or both ports 22, 24 can include a porous covering, for example, a mesh and/or a filter.

FIG. 10 illustrates an embodiment of an air transmission system for the protective garment. A fan 792 may be mounted on an inside surface of the helmet shell 794. The fan may be positioned and operate to draw air into the helmet through one or more air ports 722. Alternatively, the fan may be positioned inside a casing attached to an outside surface of shell 794. More that one fan may also be used.

The fan 792 draws air from outside the helmet through air port 722. The air is then distributed through one or more air channels. For example, an air channel 788 may extend toward the front portion 764 of the helmet 704 near the top of the transparent portion 712. One or more outlets 790 in the air channel 788 direct air into the interior volume of the helmet. The outlets 788 may be angled such that they direct air onto the head or face of the wearer, or may be angled such that they direct air onto or along the transparent portion 712 of the helmet. The helmet may also include an additional air channel 780 extending toward a rear portion of the helmet. The rear channel 780 also includes one or more outlets 782 that direct air into the interior of the helmet. These outlets may be angled to direct air onto the head or neck of the wearer. In addition a side air channel 784 may pass along sides and into a chin area 768 of the helmet. The side/chin air channel 784 may include one or more outlets 786 that also direct air into the interior of the helmet. The outlets 786 may be angled to direct air toward the head or face of the wearer or may be angled to direct air onto or along the transparent portion of the helmet.

Figure 11:
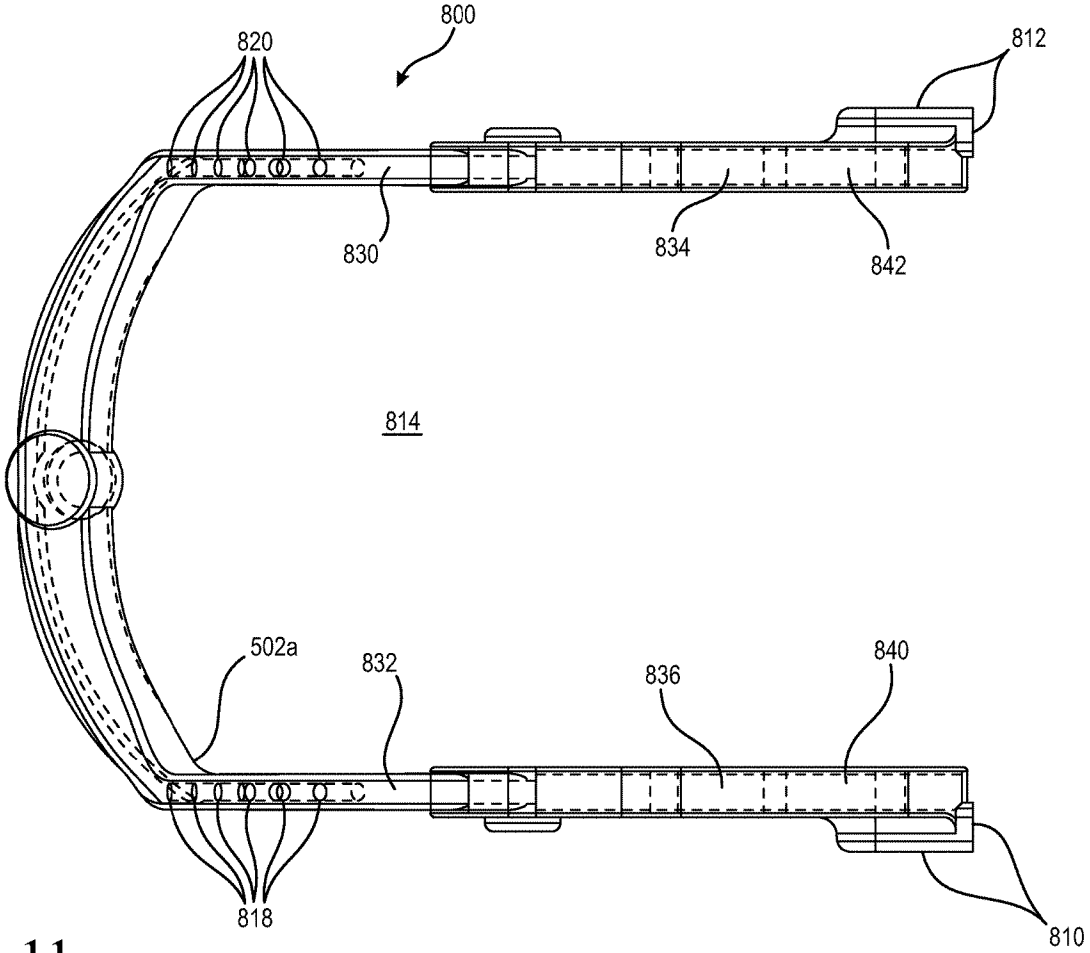
FIG. 11 is a top view of an embodiment of a side/chin air channel in accordance with the invention.

FIG. 11 illustrates a further embodiment of the air transmission system using a side/chin air channel 800. The helmet includes air transport ports located on the sides of the helmet, specifically, a first air port 810 and a second air port 812. The first air port 810 and the second air port 812 are configured to allow air to be communicated between the interior barrier space 814 of the system and the outside of the barrier. In this manner, air within the interior barrier space 814 can be replenished. In some embodiments one or more fans can be used for air circulation and/or replenishment. In this embodiment, a first fan 840 (shown in broken line) draws air into the interior barrier space 814 through the first external air port 810 while a second fan 842 (shown in broken line) exhausts air from the interior barrier space 814 through the second air port 812. The air that enters through the first air port 810 is communicated through the chambers 836, 832 and then introduced to the interior barrier space 814 by at least one inlet port 818. After flowing through the interior barrier space 814, the air that enters the air channel 800 through one or more outlets 820, travels through the one or more other of chambers 830, 834 and is exhausted from the helmet by the second blower fan 5842 through the second external port 812. While shown in FIG. 11 as including a certain shape and/or location, in some embodiments, the shape and/or location of the one or more inlet and outlet ports can vary. For example the one or more ports may be one or more slots air channel 800.

In this embodiment the inlet ports 818 can introduce air into the interior barrier space 814 from first air port 810, while the outlet ports 820 can remove air that can be exhausted from the second air port 812. This is in effect a push/pull system wherein air is introduced (pushed) into the interior barrier space 814 by the first air port 810, a first fan and the inlet ports 818 and exhausted (pulled) through the second set if internal ports 820, a second fan and the second external port 812. In this embodiment the air may be directed from the inlet ports 818 toward the transparent portion of the helmet and drawn across the transparent portion into the outlet ports 820, thereby replenishing the air in the interior barrier space 814. It is also understood by those of ordinary skill in the art that ports may be placed throughout the air channel 800. The ports may also be directed at the wearer or directed away from the wearer. Alternatively, various ports may be directed in different directions While the present disclosure and what the best modes of the invention have been described in a manner establishing possession hereof by the inventor and enabling those of ordinary skill in the art to make and use the same, it will be understood and appreciated that there are many equivalents to the exemplary embodiments disclosed herein and that the modifications and variations may be made thereto without departing from the scope and spirit of the inventions, which are to be limited not by the exemplary embodiments but by the appended claims.

What is claimed is:

1. A protective apparel system defining a barrier between an external space and an internal space, the apparel system comprising:

a sterile, reusable helmet comprising a transparent portion and a rigid barrier portion, separate from the transparent portion, wherein the rigid barrier portion comprises an exterior surface exposed to the external space and an interior surface exposed to the internal space;

a fan connected with the helmet;

a sterile disposable body portion; and a sterile, flexible disposable protective barrier connecting a lower portion of the helmet and the body portion;

wherein the helmet is adapted to cover at least a part of a head of a wearer; and wherein the disposable body portion is adapted to cover at least a part of a body of the wearer.

2. The protective apparel system of claim 1 further comprising a fastening mechanism connecting the helmet with the protective barrier.

3. The protective apparel system of claim 2 wherein the fastening mechanism comprises a hook-and-loop fastener.

4. The protective apparel system of claim 2 wherein the fastening mechanism comprises an adhesive.

5. The protective apparel system of claim 2 wherein the protective barrier is connected with the exterior surface of the helmet.

6. The protective apparel system of claim 2 wherein the protective barrier is connected with an interior surface of the helmet.

7. The protective apparel system of claim 2 wherein the protective barrier is connected with an exterior surface of the helmet and an interior surface of the helmet.

8. The protective apparel system of claim 1 wherein the protective barrier contacts an exterior surface of the body portion.

9. The protective apparel system of claim 1 wherein the protective barrier contacts an interior surface of the body portion.

10. The protective apparel system of claim 1 wherein the protective barrier is attached to the body portion.

11. The protective apparel system of claim 10 wherein the protective barrier comprises a collar extending from the body portion.

12. The protective apparel system of claim 11 wherein the collar extends into an interior area of the helmet.

13. The protective apparel system of claim 1 further comprising an air transmission system.

14. The protective apparel system of claim 13 wherein the helmet comprises an air port connected with the air transmission system.

15. The protective apparel system of claim 1, wherein the reusable helmet can withstand repeated sterilization.

16. The protective apparel system of claim 1, wherein the reusable helmet can withstand repeated disinfection.

17. The protective apparel system of claim 2 wherein the fastening mechanism continuously connects the helmet with the protective barrier.

18. A protective apparel system defining a barrier comprising:

a sterile helmet comprising a transparent portion and a rigid barrier portion, separate from the transparent portion, wherein the rigid barrier portion comprises an exterior surface exposed to an external space and an interior surface exposed to an interior space defined by the helmet;

a fan connected with the helmet;

a sterile disposable gown adapted to cover at least a part of a body of a wearer and having an exterior surface exposed to the external space;

a sterile, flexible disposable protective barrier connecting the helmet and the gown.

19. The protective apparel system of claim 18 wherein the helmet is reusable, and the exterior surface of the helmet is disinfectable.

20. The protective apparel system of claim 19 further comprising a fastening mechanism connecting the protective barrier with the helmet.

21. A protective apparel system defining a barrier comprising:

a sterile, reusable helmet comprising: a transparent portion, a rigid barrier portion separate from the transparent portion, and an air port extending through the rigid barrier portion, wherein the rigid barrier portion comprises an exterior surface that is disinfectable and exposed to an external space and an interior surface that is exposed to an internal space;

a fan connected with the helmet;

a sterile disposable gown covering at least a part of a body of a wearer;

a sterile, flexible disposable protective barrier connecting the helmet and the gown;

a fastening mechanism attaching the protective barrier to the helmet; and an air transmission system in fluid connection with the air port and comprising an air channel.

22. A protective apparel system defining a barrier between an external space and an internal space, the apparel system comprising:

a sterile reusable helmet comprising an upper portion, a lower portion, a front facing portion and a rear facing portion, the front facing portion comprising a transparent portion exposed to the external space, and the upper portion comprising a rigid barrier having an exterior surface exposed to the external space and an interior surface exposed to the internal space;

a fan connected with the helmet;

a sterile, flexible disposable body portion;

a sterile, flexible disposable protective barrier connecting the helmet and the body portion; and a sterile fastening mechanism connecting the disposable protective barrier to a lower portion of the helmet;

wherein, the helmet is adapted to cover at least a part of a head of a wearer; the helmet lower portion includes an opening adapted to receive a human head; the helmet can withstand repeated disinfection; and the disposable body portion is adapted to cover at least a part of a body of the wearer.

* * * * *